United States Patent [19]

Iwanaga et al.

[11] Patent Number: 4,612,892

[45] Date of Patent: Sep. 23, 1986

[54] AIR-FUEL RATIO CONTROL SYSTEM

[75] Inventors: Toshikazu Iwanaga, Mitaka; Kazuo Hara, Musashino, both of Japan

[73] Assignee: Fuji Jukogyo Kabushiki Kaisha, Tokyo, Japan

[21] Appl. No.: 787,415

[22] Filed: Oct. 15, 1985

[30] Foreign Application Priority Data

Oct. 22, 1984 [JP] Japan ..... 59-222625

[51] Int. Cl.[4] ..... F02M 51/00

[52] U.S. Cl. ..... 123/438; 123/440; 123/339; 123/489

[58] Field of Search ..... 123/438, 440, 489, 492, 123/493, 339

[56] References Cited

U.S. PATENT DOCUMENTS 4,344,400 8/1982 Asano ..... 123/440
4,364,358 12/1982 Shikata et al. ..... 123/440
4,398,517 8/1983 Kubota et al. ..... 123/440
4,475,512 10/1984 Suzuki et al. ..... 123/440
4,479,464 10/1984 Kondo et al. ..... 123/489
4,483,296 11/1984 Kataoka ..... 123/440
4,512,313 4/1985 Tsuchida et al. ..... 123/489

*Primary Examiner*—Raymond A. Nelli
*Attorney, Agent, or Firm*—Martin A. Farber

[57] ABSTRACT

An air-fuel ratio control system for an internal combustion engine has an electromagnetic valve for correcting the air-fuel ratio of air-fuel mixture, an $O_2$ sensor for detecting oxygen concentration in exhaust gases, and a feedback control circuit including a PI circuit for producing a PI value, and a pulse generating circuit responsive to the PI value for generating pulses duty ratio of which is dependent on the PI value. The PI value is corrected to a PI value operative to rapidly changing the duty ratio of the pulses so as to enrich the air-fuel mixture, ar rapid deceleration of the engine.

3 Claims, 8 Drawing Figures a b a b

AIR-FUEL RATIO CONTROL SYSTEM

BACKGROUND OF THE INVENTION

The present invention relates to an air-fuel ratio control system for an internal combustion engine, which system controls the air-fuel mixture to the stoichiometric air-fuel ratio at which ratio a three-way catalyst acts most effectively.

In a known air-fuel ratio control system for a motor vehicle, the air-fuel ratio of the air-fuel mixture burned in the engine cylinders is detected as the oxygen concentration in the exhaust gases by means of an $O_2$ sensor provided in the exhaust system of the engine, and a decision is made dependent on the output signal from the $O_2$ sensor which indicates whether the air-fuel ratio is richer or leaner than the value corresponding to the stoichiometric air-fuel ratio for producing a control signal. The control signal is applied to a proportion and integration circuit (PI circuit), the output of which is changed to pulse form. The pulses operate an electromagnetic valve so as to control the amount of bleed air in a carburetor for controlling the air-fuel ratio of the mixture. When the duty ratio of the pulses is reduced, the air-fuel mixture is enriched. Thus, the air-fuel ratio is controlled to the stoichiometric air-fuel ratio at which a three-way catalyst in the exhaust system acts most effectively. In such an air-fuel ratio control system, when the vehicle is accelerated or decelerated, the air-fuel ratio is liable to deviate from the stoichiometric air-fuel ratio.

In order to rapidly converge the deviated air-fuel ratio to the stoichiometric air-fuel ratio, the constant of the PI circuit is changed to a large value. The constant of the PI circuit is stepwisely changed to several values in accordance with driving conditions of the vehicle. The constant of the PI circuit is decreased to a small value at engine idling operation, because the air-fuel ratio does not vary largely at idling.

As shown in FIG. 5(*b*), when the vehicle is accelerated, the air-fuel mixture is enriched by the operation of the carburetor of the engine, in order to meet the requirement of the acceleration. On the other hand, the air-fuel ratio control system operates to dilute the air-fuel mixture, which is performed by increasing the duty ratio, at a large constant of the PI circuit, as shown in FIG. 5(*a*). When an accelerator pedal is released to decelerate the vehicle, the duty ratio decreases as shown by a solid line in FIG. 5(*a*) at a constant of the PI circuit. In a conventional system, when the accelerator pedal is released to idle the engine, the constant of the PI circuit becomes small as described above. Accordingly, the duty ratio slowly decreases, and hence the mixture is slowly enriched as shown in FIG. 5(*b*). As a result, the mixture remains lean at idling operation, which renders the engine idling operation unstable.

SUMMARY OF THE INVENTION

The object of the present invention is to provide a system which operates to rapidly converge the lean air-fuel mixture to the stoichiometric air-fuel ratio at the transient state from the accelerating state to the idling state.

According to the present invention, there is provided an air-fuel ratio control system for an internal combustion engine having an induction passage, means for supplying air-fuel mixture, an electromagnetic valve for correcting the air-fuel ratio of the air-fuel mixture supplied by the supply means, an $O_2$ sensor for detecting oxygen concentration in exhaust gases and a feedback control circuit including a comparator for comparing the output of the $O_2$ sensor with a reference value and for producing an output signal responsive to the comparison, a PI circuit responsive to the output signal of the comparator for producing a PI value, and a pulse generating circuit responsive to the PI value for generating pulses duty ratio of which is dependent on the PI value, the pulses being for driving the electromagnetic valve to correct the air-fuel ratio. The system further comprises engine speed detecting means for producing an engine speed signal when the engine speed is lower than a predetermined engine speed, engine deceleration detecting means for producing a deceleration signal at a predetermined deceleration, deciding means responsive to the engine speed signal and deceleration signal for producing a specific idling signal, and correcting means responsive to the specific idling signal for correcting the PI value to a PI value operative to rapidly changing the duty ratio of the pulses so as to enrich the air-fuel mixture.

In an aspect of the present invention, means is provided for detecting the duty ratio and for producing a duty ratio and for producing a duty ratio signal when the duty ratio represents the supply of lean air-fuel mixture, the duty ratio signal is used for deciding the generation of the particular idling signal.

The other objects and features of this invention will be apparently understood from the following description with reference to the accompanying drawings.

DETAILED DESCRIPTION OF THE PREFERRED EMBODIMENT

Figure 1:
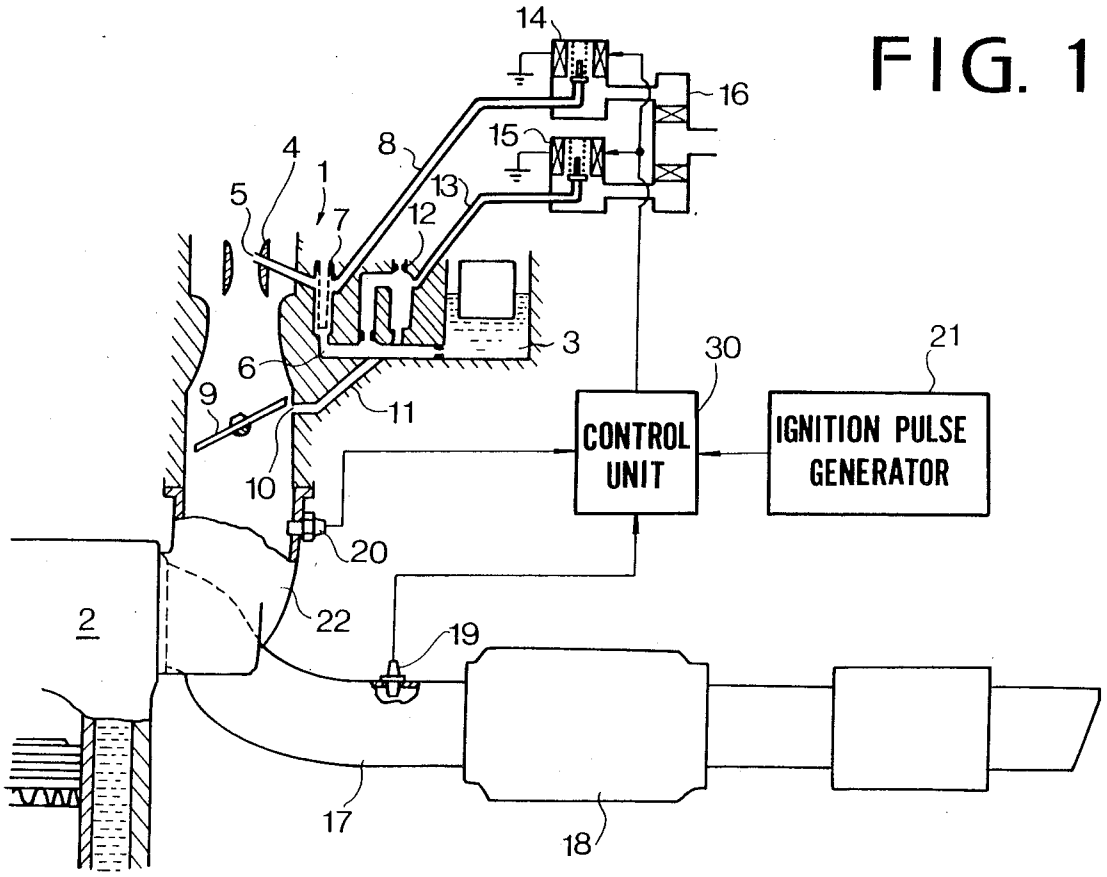
FIG. 1 is a schematic explanatory view of an air-fuel ratio control system according to the present invention.
Figure 2A:
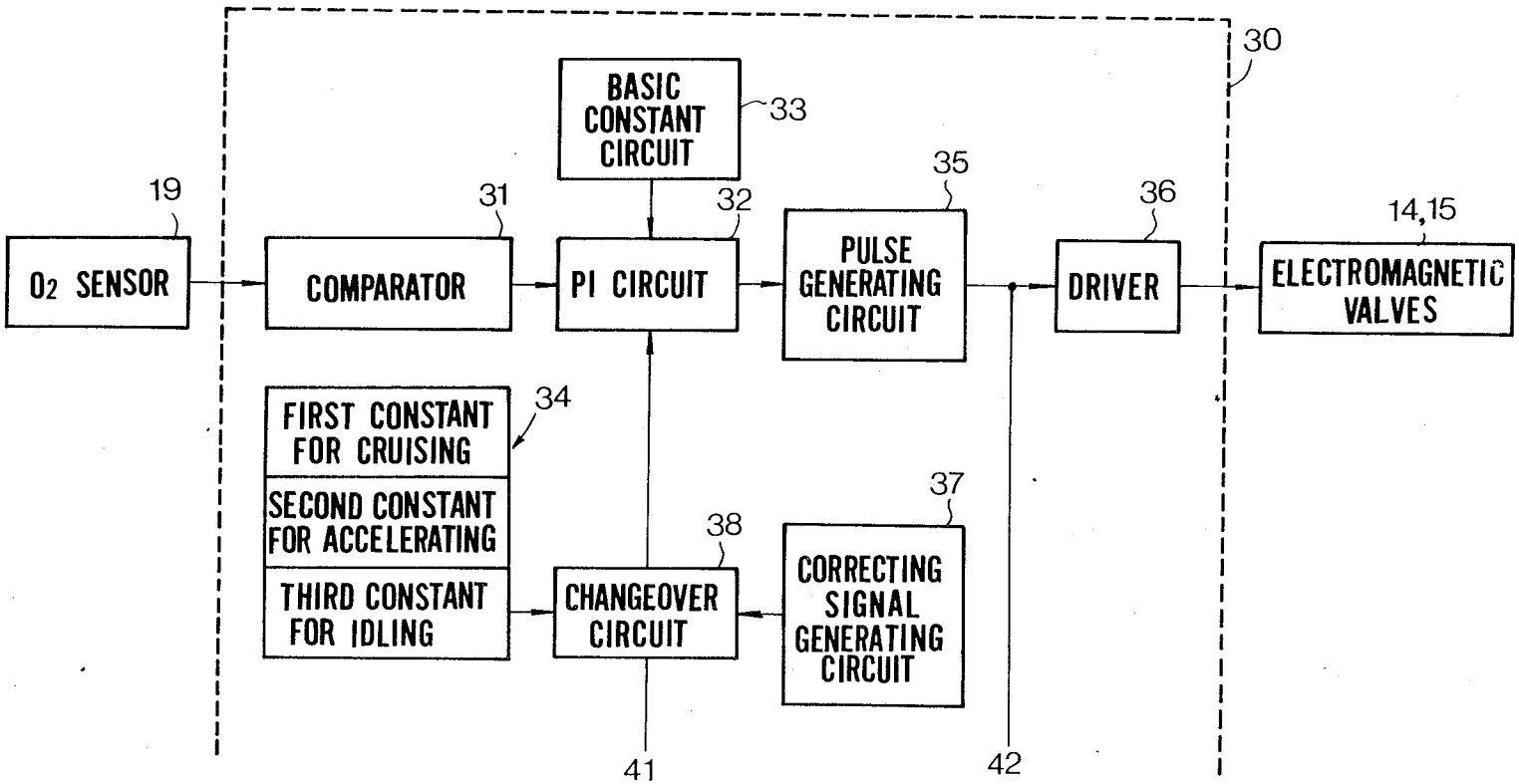
FIGS. 2*a* and 2*b* are a block diagram of the electric control circuit of the present invention.
Figure 2B:
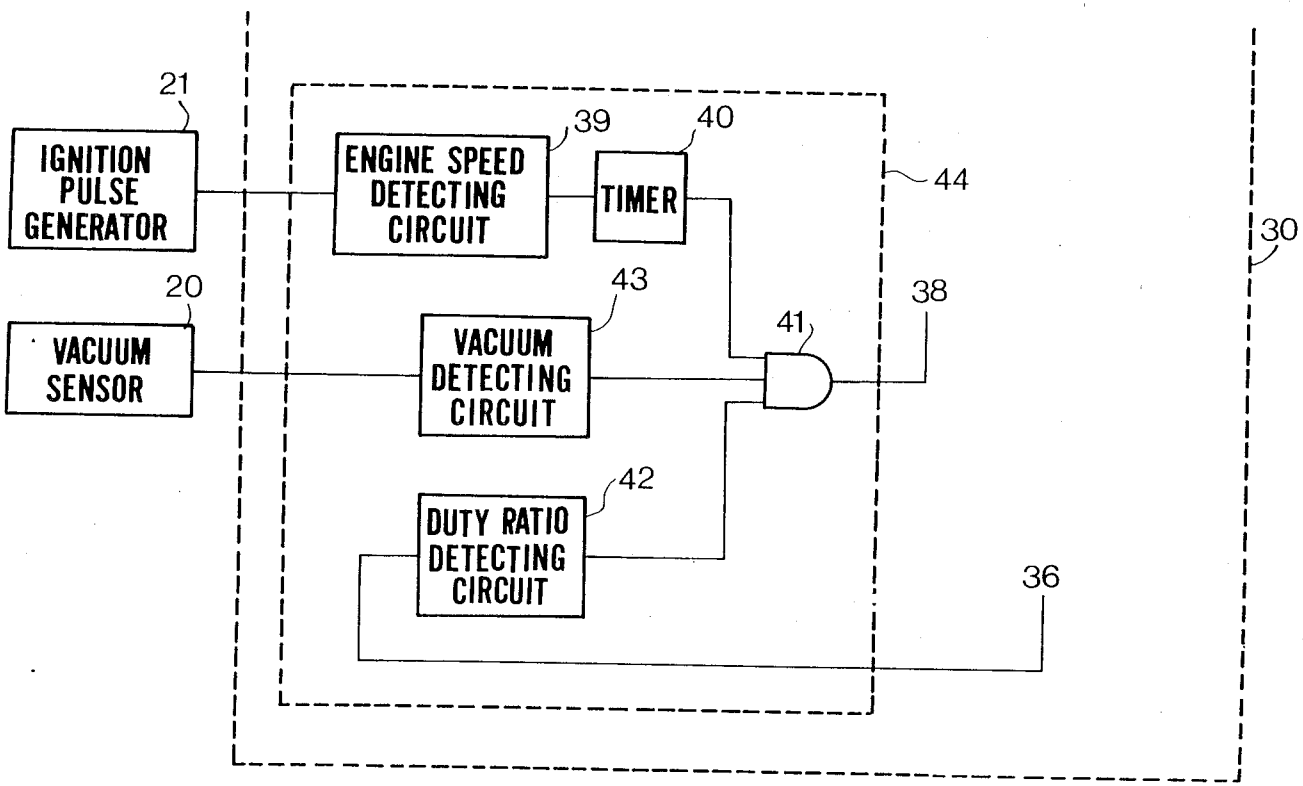

Referring to FIG. 1, a carburetor 1 is provided adjacent to an intake manifold 22 of an internal combustion engine 2. A correcting air passage 8 communicates with an air-bleed 7 which is provided in a main fuel passage 6 between a float chamber 3 and a nozzle 5 in a venturi 4. Another correcting air passage 13 communicates with another air-bleed 12 which is provided in an idle fuel passage 11 which diverges from the main fuel passage 6 and extends to an idle port 10 in the vicinity of a throttle valve 9. These correcting air passages 8 and 13 communicate with on-off type electromagnetic valves 14, 15, the induction sides of which are in communication with the atmosphere through an air cleaner 16. A three-way catalytic converter 18 is provided in an exhaust pipe 17 downstream of the engine, and an $O_2$ sensor 19 is provided between the engine 2 and the converter 18 to detect the oxygen concentration of exhaust gases when the air-fuel mixture is burned in the engine. A vacuum sensor 20 is provided in the intake manifold 22 downstream of the throttle valve 9.

The outputs of the $O_2$ sensor 19 and vacuum sensor 20 are sent to a control unit 30 which produces an output signal to actuate electromagnetic valves 14, 15 to open and close them at a duty ratio. Thus, either considerable air is supplied to the fuel system through the air correcting passages 8, 13 to produce a lean air-fuel mixture or only a small amount of air is supplied to the system so as to enrich the air-fuel mixture.

FIGS. *2a* and *2b* show the construction of the control unit 30 including a feedback control circuit. The output of the $O_2$ sensor 19 is applied to a PI(proportion and integration) circuit 32 through a comparator 31.

Generally, air-fuel ratio varies cyclically with respect to the stoichiometric air-fuel ratio. Accordingly, the output of the $o_2$ sensor 19 has a waveform having a wavelength. The output is compared with a reference value at the comparator 31 which produces pulses dependent on the waveform. The pulses are applied to the PI circuit 32, so that the PI circuit produces an output signal having a waveform as shown in FIG. *3a*. The output of the PI circuit 32 is applied to a pulse generating circuit 35 which compares the output of the PI circuit 32 with triangular wave pulses T and produces square wave pulses SP as shown in FIG. *3b*. (The output of PI circuit 32 is called PI value hereinafter). The square wave pulses are supplied to the electromagnetic valves 14, 15 via a driver 36 for operating the valves.

Figure 3:
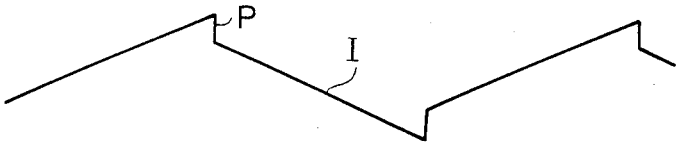
FIGS. 3*a* and 3*b* show waveforms of the output of a PI circuit and waveforms for producing pulses respectively.
Figure 3:
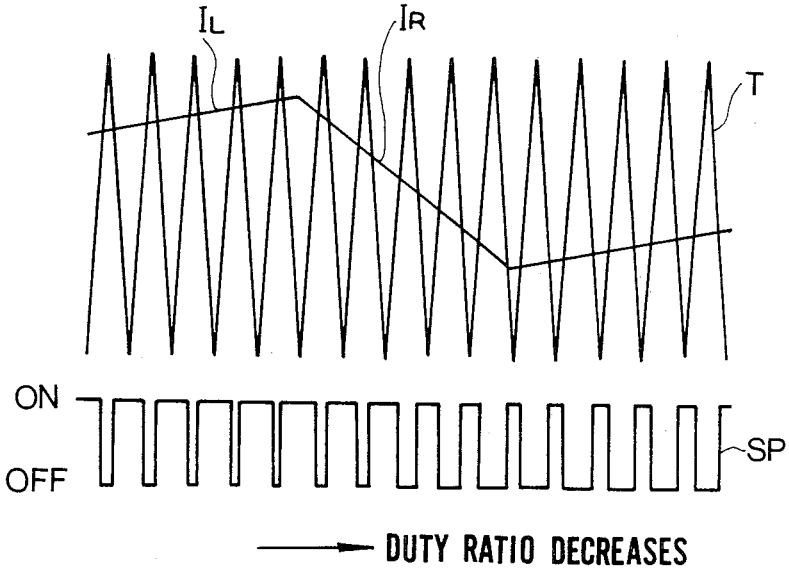

When rich air-fuel mixture is detected, the PI circuit 32 produces a positive-going PI value (FIG. *3a*), so that the duty ratio of the pulses SP becomes large as shown in FIG. *3b* so as to dilute the mixture. At lean air-fuel mixture, the PI circuit produces a negative-going PI value, which causes the duty ratio to decrease to enrich the mixture. It will be seen that the waveform of PI value shown in FIG. 3b has not a P factor (shown by P in FIG. *3a*) of proportional circuit.

The PI circuit 32 is supplied with a basic constant signal from a basic constant circuit 33 and various constant correcting signals from correcting signal generating circuits 34 and 37 through a changeover circuit 38. The circuit 34 produces a first signal for driving the vehicle at a cruising speed, a second signal for accelerating the vehicle and a third signal for idling of the engine. The circuit 37 produces a fourth signal for a particular idling operation which is dealt with the system of the invention. References IL and IR in FIG. *3b* show PI value at the particular idling operation. The negative going PI value IR is rapidly decreased by a large constant dependent on the fourth signal, so that the duty ratio is quickly reduced as shown in FIG. *3b*.

The changeover switch 38 is operated by an output of a specific idling operation detecting circuit 44. The circuit 44 comprises an engine speed detecting circuit 39 and a manifold vacuum detecting circuit 43. The engine speed detecting circuit 39 is applied with ignition pulses from an ignition pulse generator 21, and produces a high level output when engine speed is below a predetermined low speed (1100rpm). The vacuum detecting circuit 43 is supplied with the output of vacuum sensor 20 and produces a high level output when the vacuum is higher than a predetermined high value (for example −400 mmHg), which means that the engine is rapidly decelerated by releasing of the accelerator pedal of the vehicle. The output of the engine speed detecting circuit 39 is applied to a timer 40 which is responsive to the high level output of the circuit 39 to produce a high level output for a short period (5 sec.) at the most. Even if the high level output of the circuit 39 continues over 5 seconds, the timer does not produce the output. The outputs of the timer 40 and circuit 43 are applied to an AND gate 41. On the other hand, the output of the pulse generating circuit 35 is applied to the AND gate 41 through a duty ratio detecting circuit 42 when the duty ratio is greater than a predetermined large value (50%), which means that air-fuel mixture is lean. Under such conditions, the output of AND gate 41 is applied to the changeover circuit 38, so that the circuit is operated to supply the output of the circuit 37 to the PI circuit 32.

In operation, the constant of the PI circuit 32 is decided by correcting the basic constant signal from the circuit 33 with the correcting signal from the circuit 34 in accordance with driving conditions. When rich air-fuel mixture is detected, PI circuit 32 produces a positive going PI value, so that pulses having large duty ratios are produced from the circuit 35. Thus, the air-fuel mixture is diluted.

Figure 4:
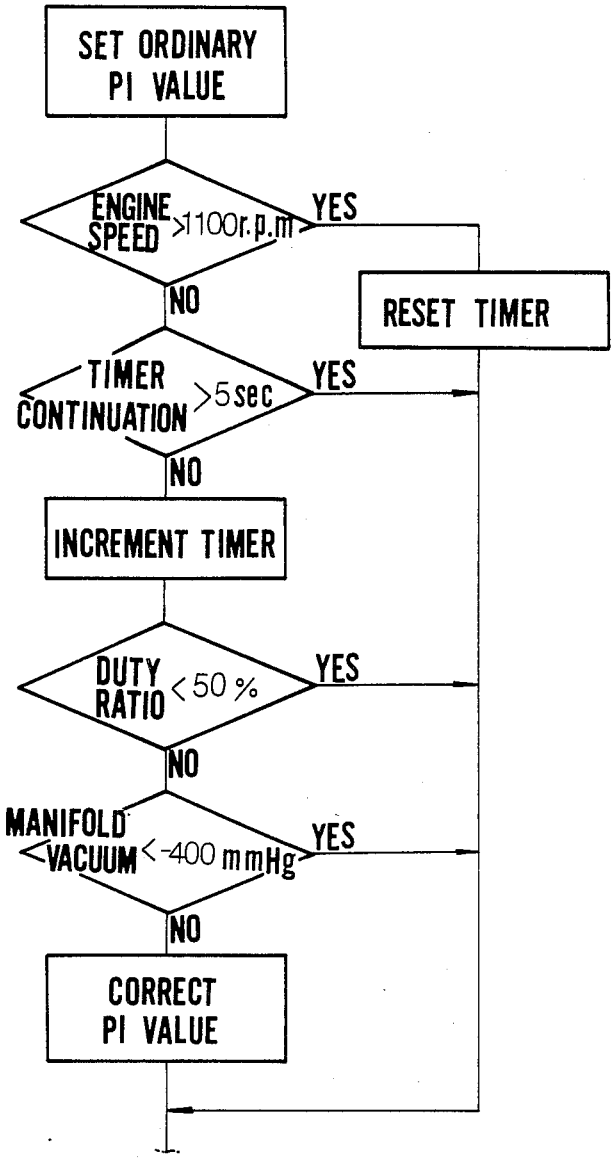
FIG. 4 shows a flowchart showing the operation of the system.
Figure 5:
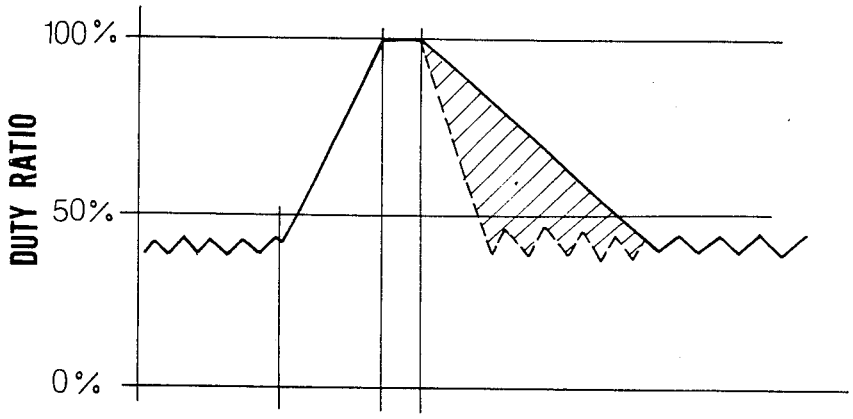
FIGS. 5*a* and 5*b* show variations of duty ratios and air-fuel ratios.
Figure 5:
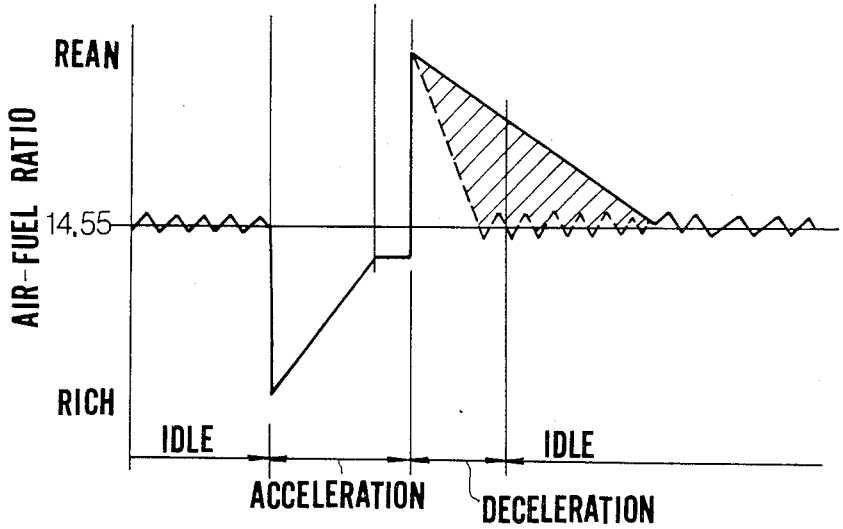

Explaining with reference to FIG. 4, when engine speed is higher than 1100 rpm, the timer 40 is reset. Until the continuation of the output of the timer 40 exceeds 5 sec, the timer is incremented. When duty ratio at that time is larger than 50% and manifold vacuum is higher than −400 mmHg, the AND gate 41 produces an output which operate the changeover switch 38. Thus, the fourth signal is applied from the correcting signal generating circuit 37 to the PI circuit. Accordingly, the negative going PI value is corrected to the PI value IR shown in FIG. *3b*, so that lean air-fuel mixture is quickly enriched.

Thus, in accordance with the present invention, duty ratio of pulses is rapidly decreased as shown by dotted line in FIG. *5a*, so that lean air-fuel mixture is quickly enriched shown by dotted line in FIG. *5b*. Accordingly, at idling operation, air-fuel mixture having the stoichiometric air-fuel ratio is supplied, thereby stabilizing the idling operation.

While the presently referred embodiment of the present invention has been shown and described, it is to be understood that this disclosure is for the purpose of illustration and that various changes and modifications may be made without departing from the scope of the invention as set forth in the appended claim.

What is claimed is:

1. In an air-fuel ratio control system for an internal combustion engine having an induction passage, means for supplying air-fuel mixture, an electromagnetic valve for correcting the air-fuel ratio of the air-fuel mixture supplied by the supply means, an $O_2$ sensor for detecting oxygen concentration in exhaust gases, and a feedback control circuit including comparator means for comparing the output of the $O_2$ sensor with a reference value and for producing an output signal responsive to the comparison, PI circuit means responsive to the output signal of the comparator means for producing a PI value, and pulse generating circuit means responsive to the PI value for generating pulses duty ratio of which is dependent on the PI value, the pulses being for driving the electromagnetic valve to correct the air-fuel ratio, the improvement comprising:

engine speed detecting means for producing an engine speed signal when the engine speed is lower than a predetermined engine speed;

engine deceleration detecting means for producing a deceleration signal at a predetermined deceleration;

deciding means responsive to the engine speed signal and deceleration signal for producing a particular idling signal;

correcting means responsive to the particular idling signal for correcting the PI value to a PI value operative to rapidly changing the duty ratio of the pulses so as to enrich the air-fuel mixture.

2. The air-fuel ratio control system according to claim 1 further comprising means for detecting the duty ratio and for producing a duty ratio singal when the duty ratio represents the supply of lean air-fuel mixture, the duty ratio signal being used for deciding the generation of the particular idling signal.

3. The air-fuel ratio control system according to claim 1 further comprising a timer for producing the engine speed signal for a predetermined time.

* * * * *